United States Patent [19]

Liller et al.

[11] 4,395,242

[45] Jul. 26, 1983

[54] METHOD OF ELECTRICALLY PROCESSING A CRT MOUNT ASSEMBLY TO REDUCE AFTERGLOW

[75] Inventors: Paul R. Liller; Donald J. Shahan, both of Lancaster, Pa.

[73] Assignee: RCA Corporation, New York, N.Y.

[21] Appl. No.: 294,132

[22] Filed: Aug. 19, 1981

[51] Int. Cl.[3] ..... H01J 9/20

[52] U.S. Cl. ..... 445/5; 445/8; 445/57

[58] Field of Search ..... 445/5, 6, 57, 8

[56] References Cited

U.S. PATENT DOCUMENTS

| | | | |
|---|---|---|---|
| 3,966,287 | 6/1976 | Liller | 445/5 |
| 4,052,776 | 10/1977 | Maskell et al. | 445/5 |
| 4,125,306 | 11/1978 | Coble | 445/5 |
| 4,214,798 | 7/1980 | Hopen | 445/5 |

*Primary Examiner*—K. J. Ramsey

*Attorney, Agent, or Firm*—E. M. Whitacre; D. H. Irlbeck; L. Greenspan

[57] ABSTRACT

In the novel method of electrically processing a completed and operative CRT, the portion of the focus electrode that faces a high-voltage electrode is heated at temperatures above about 700° C. and then is subjected to RF spot-knocking. The novel method can be applied during the initial processing of the CRT and/or subsequently during a reprocessing procedure.

6 Claims, 1 Drawing Figure

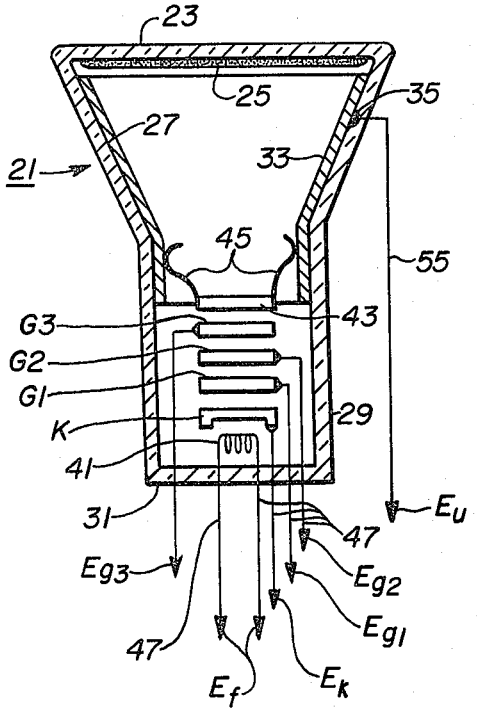
23
25
35
27
21
33
45
55
G3
43
G2
G1
29
K
41
31
$E_u$
47
$E_{g3}$
$E_{g2}$
$E_{g1}$
47
$E_f$
$E_k$

METHOD OF ELECTRICALLY PROCESSING A CRT MOUNT ASSEMBLY TO REDUCE AFTERGLOW

BACKGROUND OF THE INVENTION

This invention relates to a novel method of electrically processing a completely-assembled CRT (cathode-ray tube) to reduce afterglow during the subsequent operation of the CRT.

A CRT comprises an evacuated envelope which includes a neck, a funnel and a faceplate opposite the neck. A luminescent viewing screen is supported on the internal surface of the faceplate. A conductive coating on the inside of the funnel is one plate of a filter capacitor, and also is the anode of the CRT. An external coating on the funnel is the other plate of the filter capacitor. A mount assembly supported from a glass stem and including one or more electron guns is sealed into the neck. Each electron gun includes a cathode, a control electrode, a screen electrode, a focus electrode and a high-voltage electrode.

After the CRT is completely assembled and evacuated, the mount assembly is electrically processed so that the electron gun or guns become operative, their operation stabilized and their operating lives lengthened. This processing includes, in succession, (i) "hot-shot" wherein the cathodes are rendered electron-emitting, (ii) "low-voltage aging" wherein the electron emissions are stabilized and (iii) "spot-knocking" wherein spurious electron emission from the electrodes is reduced and the operation of the CRT is further stabilized.

Spot-knocking may be conducted before the hot-shot and also after the IIP (integral implosion protection) structure is mounted on the CRT. In ordinary spot-knocking, which is usually conducted before the hot-shot, all of the gun elements not connected to the anode are connected to ground potential, and positive low-frequency pulses are applied to the anode, causing spontaneous arcing to occur between gun elements connected to the anode and the adjacent gun elements. RF spot-knocking, which is usually conducted after the IIP structure is mounted on the CRT, is similar to ordinary spot-knocking except that RF (radio frequency) pulses are superimposed upon the low-frequency pulses, causing stimulated or forced arcing to occur between the gun elements connected to the anode and the adjacent gun elements.

A completed CRT, installed in a chassis, and operated in a normal manner, may continue to emit light from the viewing screen after the normal operating voltages are removed from the mount assembly. This effect, which may linger for minutes or hours, is referred to as afterglow and is attributed to the coincidence of two factors. First, a large residual electrostatic charge remains on the filter capacitor (which is integral with the CRT) after the operating voltages are removed. Therefore, a residual high voltage remains on the anode of the CRT and on the high-voltage electrodes of the mount assembly, which are connected to the anode, with respect to the other electrodes of the mount assembly. Second, there are sites on the electrodes of the electron gun from which electrons can be emitted when they are under the influence of the electric field produced by the residual high voltage on the high-voltage electrodes. Emitted electrons under the influence of the electric field move toward, and impinge upon, the viewing screen producing the afterglow.

SUMMARY OF THE INVENTION

In the novel method, the number and efficiency of field-emission sites are substantially reduced so that there is substantially less field emission from the electrodes, and little or no afterglow is observed after the operation of the tube. The novel method follows the prior practice including the steps of (i) hot-shot, (ii) low-voltage aging and (iii) spot-knocking, except for an additional step of heating the portion of the focus electrode facing the high-voltage electrode at temperatures above about 700° C. prior to RF spot knocking. Heating is preferably achieved by bombarding the focus electrode with electrons from the cathode of the CRT.

Where the novel method is applied to tubes that are receiving their initial electrical processing, the heating step is conducted during the low-voltage aging step, and the RF spot knocking is applied after the IIP structure is mounted on the CRT, as in prior practice. Where the novel method is applied to salvaged tubes that were rejected for excessive afterglow; that is, the tubes are being reprocessed, the heating step is conducted and then is followed by the additional step of RF spot-knocking.

BRIEF DESCRIPTION OF THE DRAWING

The sole FIGURE is a schematic representation of a CRT and an associated circuit arrangement for practicing the novel method.

DETAILED DESCRIPTION OF THE PREFERRED EMBODIMENTS

The novel method may be applied to any electron gun having a cathode and four or more electrodes which are biased independently of one another. There may be a single gun or a plurality of guns in the electron-gun mount of the cathode-ray tube. Where there is more than one gun in the mount, the guns may be in any geometric arrangement. Where there are three guns, as in a color television picture tube, for example, the guns may be arranged in a delta array, or in an in-line array, or in any other array.

The novel method may be applied, for example, to bipotential and tripotential electron-gun structures. A bipotential gun structure typically has a cathode heater and cathode K, a control electrode G1, a screen electrode G2, a single focus electrode G3 and a high-voltage electrode, which is often designated as the anode or G4. Although separate elements may be provided for each of the three electron guns of a color picture tube, recent practice has tended to use common elements for G1, G2, G3 and G4 for the three electron guns. A tripotential gun differs from a bipotential in that it employs three focus electrodes for the focusing action instead of only one. A tripotential gun typically has a cathode heater, a cathode K, a control electrode G1, a screen electrode G2, three focus electrodes G3, G4, and G5, and a high-voltage electrode, which is often designated G6. The new procedures generally will be explained principally as they relate to a bipotential gun structure. For the tripotential gun structure, the focus electrodes G3 and G5 are electrically connected, and the G2 and G4 electrodes are electrically connected when the novel method is being practiced.

Cathode-ray tubes may be processed according to the novel method in a succession of stations having equipments which can apply, for the various processing steps, programs of voltages to the cathode and the various electrodes of each electron gun in the CRT. The CRT may be transported by hand or on a conveyor from station to station as is known in the art. Suitable conveyors are described in U.S. Pat. Nos. 2,917,357 to T. E. Nash and 3,698,786 to Edward T. Gronka. The novel method will be exemplified now on a tube that is transported by hand. At each station, the tube is placed in a holder therefor, and a socket is connected to the base pins of the CRT.

The general sequence of steps for processing a completely-assembled CRT includes pre-age spot-knocking, then hot-shot, then low-voltage aging. Then, optionally, there may be another step of ordinary spot-knocking. An integral implosion protection structure may then be assembled to the CRT. Then, a step of RF spot-knocking is applied. Since all of the foregoing steps, except for the novel step, are well described in the prior art, no further description will be made herein. Embodiments of the novel method will now be described in detail with respect to the sole FIGURE.

The sole FIGURE includes a schematic, sectional, elevational view of a CRT 21 including a faceplate panel 23 carrying on its inner surface a luminescent viewing screen 25. The panel 23 is sealed to the larger end of a funnel 27 having a neck 29 integral with the smaller end of the funnel 27. The neck 29 is closed by a stem 31. The inner surface of the funnel 27 carries a conductive coating 33 which contacts an anode button 35.

The neck 29 houses a bipotential electron-gun mount assembly such as the mount assembly described in U.S. Pat. No. 3,772,554 to R. H. Hughes. This assembly includes three bipotential guns, only one of which is illustrated in the sole FIGURE. The mount assembly includes two glass support rods from which the various gun elements are mounted. The gun elements of each gun include a cathode heater 41, a cathode K, a control electrode G1, a screen electrode G2, a focusing electrode G3 and a high-voltage electrode 43. The high-voltage electrode 43 is connected to the conductive coating or anode 33 with snubbers 45. The heater 41, the cathode K, the control electrode G1, and the screen electrode G2, which are referred to herein as the lower-voltage gun elements, are connected to separate stem leads 47 which extend through the stem 31. The focus electrode G3 is also connected to a separate G3 lead 49 which extends through the stem 31.

During the electrical processing of a completed (evacuated and sealed) CRT, the stem leads 47 are inserted into a socket (not shown), and each lead is connected to a separate voltage source (not shown). The mount assembly is subject to a program of voltages which are applied through the leads 47 in which the following nomenclature is used:

$E_f$ is the voltage applied across the cathode heater 41, $E_k$ is the voltage applied to the cathode K, $E_{g1}$ is the voltage applied to the control electrode G1, $E_{g2}$ is the voltage applied to the screen electrode G2, $E_{g3}$ is the voltage applied to the focusing electrode G3, and $E_u$ is the voltage applied to the high-voltage electrode G4 through the connection to the conductive internal funnel coating 33 or anode.

The novel method is exemplified below in two examples. In Example 1, the tube is being initially processed according to the novel method. In Example 2, a tube that has been rejected for exhibiting excessive afterglow is being reprocessed according to the novel method. In each example, a tube is transported by hand to a holder where a socket (not shown) is connected to the base pins or leads of the tube. In Example 1, the holder is on a conveyor as described above. In Example 2, the holder is one of sixteen holders in a reprocessing apparatus.

EXAMPLE 1

Initial Processing Procedure

Step 1—Preage Spot-Knocking—The cathode, the heater and the G1, G2 and G3 electrodes are electrically connected together and grounded. The G4 or high-voltage electrode 43 is connected to a source which supplies a train of pulses of positive voltage through the anode button 35. The pulses rise from ground potential initially to plus 35±5 kilovolts, increasing linearly to plus 60±5 kilovolts in 90 to 120 seconds. Each successive pulse is comprised of an ac voltage peaking at a higher value and having a frequency of 60 hertz. The negative portion of the ac voltage is clamped to ground potential. The duration of the pulses may be in the range of 0.1 to 0.2 second (6 to 12 cycles), and the spacing of the pulses may be in the range of 0.5 to 1.0 second.

Step 2—Cathode Conversion—Apply $E_f=9.3\pm0.5$ volts for about 60 seconds. All other elements are electrically floating.

Step 3—Hotshot—Apply $E_f=11.2\pm0.5$ volts for 90 to 120 seconds. All other elements are electrically floating.

Step 4—Low Voltage Aging and Heating by Electron Bombardment—Apply $E_f=9.2\pm0.4$ volts, $E_k=0$, $E_{g1}=0$, Eu is electrically floating, and $E_{g2}$ and $E_{g3}$ (approximate) are as follows for the indicated successive time periods in minutes:

| Time (minutes) | $E_{g2}$ (volts) | $E_{g3}$ (volts) |
|---|---|---|
| 1 | Floating | Floating |
| 10 | +375 | Floating |
| 5 | +375 | +375 |
| 15 | +450 | +1000 to +1400 |
| 25 | +375 | Floating |
| 5 | Floating | Floating |

During the application of $E_{g2}=+450$ and $E_{g3}=+1000$ to +1400, the electron beams from the cathodes strike the G3 and heat that portion of the G3 that faces the high-voltage electrode 43 to temperatures above about 700° C. After the $E_{g3}$ voltage is removed, the G3 cools.

Step 5—Post IIP RF Spot-Knocking—After the implosion-protection system is assembled to the CRT, an RF spot-knocking procedure is applied as follows. The cathode, the heater and the G1, G2 and G3 are connected to a high-voltage RF power supply which is connected to ground. The high-voltage electrode 43 is connected to a low-frequency source which supplies a train of 60-hertz positive half-wave pulses through the anode button 35. The 60-hertz pulses rise from ground potential initially to plus 45±10 kilovolts and are applied for about 2 minutes. Simultaneously, high-frequency pulses of about 150±15 kv peak-to-peak from the RF power supply are applied and superimposed on the 60 hertz pulses. The high-frequency pulses have a frequency of about 350 kilohertz, last for about 5 to 7 cycles thereof, and occur at about the peak of every second or third low-frequency pulse. Optionally, the G3 electrode may be floating electrically instead of being connected to the high-frequency power supply.

Step 6—Final Cathode Aging—Apply $E_f=9.3\pm0.5$ volts dc for about 5 minutes. All other elements are electrically floating.

Testing for Afterglow

An operative CRT may be tested for afterglow with the following procedure, which is conducted in a darkened room. All of the electrodes of the CRT are grounded except for the anode. The anode voltage is increased until some portion of the viewing screen is excited to luminescence as viewed with the human eye. Only a localized area need light up, and the area may differ for different tubes. Then, the anode voltage is slowly reduced until all luminescence of the screen just disappears. The anode voltage at which this occurs is called the extinction voltage or $E_{ext}$. The $E_{ext}$ for a particular CRT is compared with a known threshold extinction voltage and the tube is rejected if $E_{ext}$ is below this threshold, or accepted if $E_{ext}$ is at or above this threshold. The threshold extinction voltage always has a value between the operating anode voltage (Eu) of the CRT and the difference between the operating anode voltage and the operating focus voltage ($Eu-E_{g3}$). For an acceptable tube including the in-line mount assembly shown in the sole FIGURE above, $E_{ext>Eu-Eg3}>30-7$ kv$>23$ kv, approximately.

EXAMPLE 2

Reprocessing Procedure

Step 1—Heating by Electron Bombardment—Apply to a CRT being reprocessed $E_f=9.2\pm0.4$ volts, $E_k=0$, $E_{g1}=0$, $E_{g2}=450$ volts, Eu is electrically floating and $E_{g3}$ is about $+1000$ to $+1400$ volts DC for about 15 minutes. During the application of the $E_{g3}$ voltage, the electron beams from the cathodes strike the G3 and heat that portion of the G3 that faces the high-voltage electrode 43 to temperatures above about 700° C. After the $E_{g3}$ voltage is removed, the G3 cools.

Step 2—Cool—All elements are floating for about 15 minutes.

Step 3—RF Spot Knocking—Follow step 6 of Example 1.

Step 4—Final Cathode Aging—Apply $E_f=9.3\pm0.5$ volts for about 5 minutes. All other elements are floating.

GENERAL CONSIDERATIONS

The novel method reduces the flow of field-emission electrons which impinge upon the viewing screen of a color picture tube and produce a phenomenon referred to as stray emission, or when visible on the screen after the receiver is turned off, afterglow. Stray emission is a defect in which field-emission electrons, generally from the focus electrode, are attracted to the screen and compete with the well-controlled thermionic electron beams from the three electron guns in forming the desired image on the screen. If the level of the current causing the stray emission is too high, of the order of microamperes, the picture quality is adversely affected by blemishes (screen lighting) created by the undesired stray-emission electrons. In practically all well-designed modern picture tubes, the electrical processing of the tube is adequate to limit the stray emission to values which will not blemish the picture under standard scanning conditions.

The stray emission does become a problem, however, in some types of television receivers which do not provide for reduction of the anode voltage by means of a bleeder resistance upon receiver shutdown. In many of the receivers of this type, when the receiver is turned off after operation, the anode voltage remains at relatively high level while the focus-electrode potential is reduced to ground level. This creates a situation in which the potential gradient between the high-voltage electrode and the focus electrode can be higher than it is during normal operating conditions. Since the screen is unscanned during receiver shutdown, relatively small currents, of the order of tens of nanoamperes, can form quite noticeable patterns on the screen which may persist for long time periods. Screen illumination produced by stray emission under these conditions is referred to as afterglow, a phenomenon which can be of great annoyance to persons near the receiver.

Stray emission may be produced by minute whisker-like projections on the top surface of the focus electrode which tend to concentrate at or near grain boundaries. As indicated above, stray emission is usually restricted to relatively low current levels by high-voltage processing, which is designed to erode the initial emission sites. This processing is not adequate by itself to process all tubes to be free from afterglow. It is believed new projections are formed under the attractive force of the electric field, during the high-voltage processing step. Under the usual processing schedules, then, the high-voltage processing can create new electron sites almost as fast as the old ones are being neutralized.

It has been demonstrated in the laboratory that field emission can be greatly enhanced by heating a metallic component which has been created by extrusion and/or forming processes. Apparently, slivers and burrs are pressed into the surface during the forming where they remain buried until sufficient heat is applied to remove the constraints and permit the projections to rise from the surface. In most tube processes, the gun structure is heated during the exhaust cycle of the tube; for example, by induction heating with radio-frequency energy. Numerous tests have shown that the field emission is greater than the initial value after this process. The field emission is always reduced by subsequent high-voltage processing, usually be spot-knocking, which indicates that most of the newly-formed projections have been eroded. Unfortunately, in too many cases, the residual stray-emission level is not sufficiently low to prevent afterglow.

The novel method for minimizing the incidence of afterglow is to generate high intensity heating at the portion of the focus electrode most likely to generate field emission sites; and that is the top of the focus electrode and, specifically, the surface immediately adjacent to and facing the high-voltage electrode. The heat is sustained for a sufficient period to insure that most incipient emission sites will emerge. The strategy minimizes the probability that additional sites will emerge during subsequent RF spot-knocking. Another important additional benefit of this high intensity heating is to drive off barium (deposited on the focus electrode during getter flash) which contributes to the intensity of the stray emission by reducing the work function at the emission sites.

A practical method of heating the top of the focus electrode is by bombardment with electrons thermally generated in the electron gun. The power necessary for the required amount of heating will vary considerably in accordance with the tube size and design, but the heat should be sufficient to maintain temperatures at the top of the focus electrode in excess of 700° C. for about 15 minutes. For an in-line gun structure, these conditions are attained by operating the heaters at about 9.5 volts and applying about 450 volts dc and about 1000 to 1400 volts dc to the screen electrode and focus electrode, respectively. All other electrodes are grounded.

Neither the heating of the top of the focus electrode by electron bombardment nor the subsequent RF spot-knocking is considered novel; both are well known processes that have been employed previously in tube manufacture. The invention lies in the discovery that concentrated heating of the focus electrode followed by energetic RF spot-knocking of the focus electrode will promote a condition where the number and efficiency of field emission sites are reduced substantially and where the probability of the formation of new field-emission sites is minimal. In prior methods, considerable efforts were expanded in minimizing the heating of the focus electrode in order to restrict the formation of new field-emission sites. The new method promotes this heating at even higher temperatures so that most of the potential field-emission sites may be formed and then reduced in number and efficiency.

What is claimed is:

1. In a method of electrically processing a completed CRT having an electron gun including a focus electrode and a high-voltage electrode, said high-voltage electrode being closely spaced from said focus electrode, the steps comprising (a) heating the portion of said focus electrode that faces said high-voltage electrode at temperatures above about 700° C., (b) and then RF spot-knocking said portions of said focus electrode.

2. The method defined in claim 1 wherein heating step (a) is carried out during a step of low-voltage aging before an integral implosion protection structure is mounted on said CRT and wherein said RF spot-knocking step (b) is carried out after said integral implosion protection structure is mounted on said CRT.

3. The method defined in claim 1 wherein said steps (a) and (b) are both carried out after an integral implosion protection structure is mounted on said CRT.

4. The method defined in claim 1 wherein said heating step (a) is continued for about 15 minutes.

5. The method defined in claim 1 wherein said heating step (a) is achieved by bombarding said focus electrode with electrons from said cathode.

6. The method defined in claim 5 wherein said electron gun includes a screen electrode and a cathode, and said heating step (a) includes simultaneously rendering said cathode electron-emitting, applying about +450 volts to said screen electrode, about +1000 to +1400 volts to said focus electrode and grounding all other electrodes.

* * * * *